US011851767B2

(12) United States Patent
Niwa et al.

(10) Patent No.: US 11,851,767 B2
(45) Date of Patent: Dec. 26, 2023

(54) RUST PREVENTION MEMBER AND METHOD FOR PRODUCING SAME

(71) Applicant: YUKEN INDUSTRY CO., LTD., Aichi (JP)

(72) Inventors: Tsukasa Niwa, Aichi (JP); Toshihiro Sugiura, Aichi (JP); Yoshiki Hiramatsu, Aichi (JP); Hiroki Yoshida, Aichi (JP)

(73) Assignee: YUKEN INDUSTRY CO., LTD., Aichi (JP)

( * ) Notice: Subject to any disclaimer, the term of this patent is extended or adjusted under 35 U.S.C. 154(b) by 924 days.

(21) Appl. No.: 16/626,868

(22) PCT Filed: Jun. 26, 2018

(86) PCT No.: PCT/JP2018/024107
§ 371 (c)(1),
(2) Date: Dec. 26, 2019

(87) PCT Pub. No.: WO2019/004163
PCT Pub. Date: Jan. 3, 2019

(65) Prior Publication Data

US 2020/0115803 A1 Apr. 16, 2020

(30) Foreign Application Priority Data

Jun. 29, 2017 (JP) ..... 2017-127192

(51) Int. Cl.
*C23C 10/52* (2006.01)
*C23C 22/78* (2006.01)
(Continued)

(52) U.S. Cl.
CPC ..... *C23C 22/78* (2013.01); *C23C 22/82* (2013.01); *C23C 28/00* (2013.01); *C25D 3/22* (2013.01)

(58) Field of Classification Search
None
See application file for complete search history.

(56) References Cited

U.S. PATENT DOCUMENTS

2003/0190492 A1 10/2003 Wada et al.
2006/0166013 A1 7/2006 Endo et al.

FOREIGN PATENT DOCUMENTS

JP H11335864 12/1999
JP 3620510 2/2005
(Continued)

OTHER PUBLICATIONS

Office Action of China Counterpart Application, with English translation thereof, dated Mar. 3, 2022, pp. 1-10.
(Continued)

*Primary Examiner* — Lois L Zheng
(74) *Attorney, Agent, or Firm* — JCIPRNET

(57) ABSTRACT

As a rust prevention member that has excellent corrosion resistance, while being provided with a coating film that contains Si, a rust prevention member which is provided with a base material, a zinc-based plating layer that is provided on the base material, and a chemical conversion coating film that contains Si and is provided on the zinc-based plating layer is described. This rust prevention member is characterized in that the chemical conversion coating film has an Si-rich region on the surface side, said Si-rich region having an atomic ratio of the Si content to the Zn content of 1 or more, while having a thickness of 100 nm or more.

6 Claims, 5 Drawing Sheets

(51) Int. Cl.

| | |
|---|---|
| ***C23C 22/82*** | (2006.01) |
| ***C23C 28/00*** | (2006.01) |
| ***C25D 3/22*** | (2006.01) |
| *C23C 10/28* | (2006.01) |

(56) References Cited

FOREIGN PATENT DOCUMENTS

| | | |
|---|---|---|
| JP | 2007162040 | 6/2007 |
| JP | 2008133502 | 6/2008 |
| JP | 2009041092 | 2/2009 |
| JP | 2009255566 | 11/2009 |
| JP | 2013249528 | 12/2013 |

OTHER PUBLICATIONS

Office Action of Japan Counterpart Application, with English translation thereof, dated Dec. 3, 2019, pp. 1-8.

"International Search Report (Form PCT/ISA/210) of PCT/JP2018/024107," dated Jul. 31, 2018, with English translation thereof, pp. 1-2.

"Office Action of Japan Counterpart Application", dated Jun. 9, 2020, with English translation thereof, pp. 1-7.

Office Action of China Counterpart Application, with English translation thereof, dated May 8, 2021, pp. 1-12.

"Search Report of Europe Counterpart Application", dated Apr. 6, 2021, pp. 1-8.

"Decision of Rejection of China Counterpart Application", dated Oct. 27, 2022, with English translation thereof, p. 1-p. 13.

RUST PREVENTION MEMBER AND METHOD FOR PRODUCING SAME

CROSS-REFERENCE TO RELATED APPLICATION

This application is a 371 application of the international PCT application serial no. PCT/JP2018/024107, filed on Jun. 26, 2018, which claims the priority benefit of Japan application no. 2017-127192, filed on Jun. 29, 2017. The entirety of each of the above-mentioned patent applications is hereby incorporated by reference herein and made a part of this specification.

TECHNICAL FIELD

The present invention relates to a rust prevention member and a method for producing the same.

BACKGROUND ART

Patent Literature 1 describes a corrosion resistant base material which has a two-layer structure chemical conversion treatment coating film formed of a lower layer containing Cr and an upper layer containing $SiO_2$ by one liquid treatment on a surface layer of a base material to be treated in which a zinc or zinc alloy plating layer is provided.

CITATION LIST

Patent Literature

[Patent Literature 1]
Japanese Patent No. 3620510

SUMMARY OF INVENTION

Technical Problem

The present invention provides a rust prevention member having a coating film that contains Si as described in Patent Literature 1 to have excellent corrosion resistance and a method for producing such a rust prevention member.

Solution to Problem (1) A rust prevention member includes a base material, a zinc-based plating layer provided on the base material, and a chemical conversion coating film provided on the zinc-based plating layer and containing Si, and the chemical conversion coating film has a Si-rich region in which an atomic ratio of a Si content to a Zn content is 1 or more on a surface layer side with a thickness of 100 nm or more.

(2) In the chemical conversion coating film according to the above-described (1), the chemical conversion coating film has a gradient region in which the Zn content increases toward the zinc-based plating layer between the Si-rich region and the zinc-based plating layer.

(3) In the chemical conversion coating film according to the above-described (2), a thickness of the gradient region is 50 nm or more.

(4) In the chemical conversion coating film according to the above-described (2) or (3), the Si-rich region and the gradient region is continuous in a thickness direction.

(5) In the chemical conversion coating film according to any one of the above-described (1) to (4), the chemical conversion coating film further contains one or more elements selected from the group consisting of Cr, P, B, C, S, O, Li, Ca, Mg, Mo, V, Nb, Ta, W, Zr, Fe, Ni, Co, Cu, Si, Ti, Zn, Al, Sn, Bi, and lanthanoids.

(6) In the chemical conversion coating film according to any one of the above-described (1) to (5), the chemical conversion coating film is a chemical conversion coating film of a reactive type.

(7) In the chemical conversion coating film according to any one of the above-described (1) to (6), the chemical conversion coating film contains silicon oxide.

(8) In the chemical conversion coating film according to any one of the above-described (1) to (7), the chemical conversion coating film contains substantially no organic binder component.

(9) A method for producing the rust prevention member according to the above-described (7) includes a plating step of forming the zinc-based plating layer on the base material to obtain a member to be treated having the base material and the zinc-based plating layer, and a chemical conversion treatment step of forming the chemical conversion coating film on the member to be treated by bringing the member to be treated into contact with a chemical conversion treatment liquid and then washing the member to be treated, in which the chemical conversion treatment liquid contains a chemical conversion element-containing substance containing an element that performs a chemical conversion reaction, and silicon oxide.

Advantageous Effects of Invention

According to the present invention, a rust prevention member having a coating film that contains Si and having excellent corrosion resistance is provided. Also, a method for producing such a rust prevention member is also provided.

DESCRIPTION OF EMBODIMENTS

Figure 1:
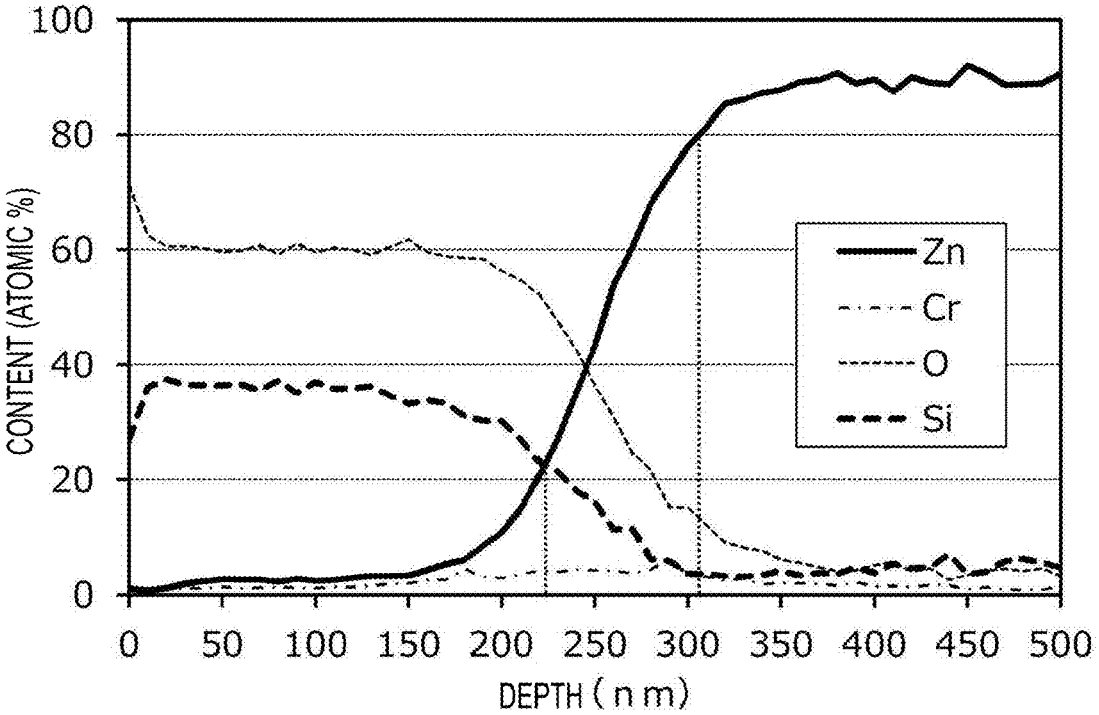
FIG. 1 is a depth profile of a rust prevention member according to Example 1.

Hereinafter, an embodiment of the present invention will be described.

A rust prevention member according to one embodiment of the present invention includes a base material, a zinc-based plating layer, and a chemical conversion coating film as will be described below.

A material constituting the base material is arbitrary. As a specific example, metal-based materials such as aluminum-based materials and iron-based materials, ceramic-based materials such as alumina, organic materials such as liquid crystal plastics, and composite materials such as epoxy resins in which glass fillers are dispersed can be exemplified. A shape of the base material is also arbitrary. The shape may be a flat plate shape or a complicated shape having irregularities. As a specific example of members having such a complicated shape, a brake caliper can be exemplified.

The zinc-based plating layer is formed on the base material. The zinc-based plating layer may be formed by electroplating or may be formed by electroless plating. When the zinc-based plating layer is formed by electroplating, there are cases in which a treatment for imparting conductivity to the base material is preferably performed. A material constituting the zinc-based plating layer may contain only zinc or may contain substances besides zinc. In a case of substances besides zinc being contained, the zinc-based plating layer may be formed of a zinc alloy containing elements besides Zn, such as Ni.

The chemical conversion coating film is a coating film formed by a chemical conversion reaction generated between a metal element constituting the zinc-based plating layer and an element contained in a chemical conversion treatment liquid. Accordingly, the chemical conversion coating film contains a constituent element of the zinc-based plating layer, particularly Zn. Types and states of elements (also referred to as a "chemical conversion element" in this specification) contained in the chemical conversion treatment liquid and responsible for the chemical conversion reaction are not limited, and Cr (trivalent chromium) may be exemplified. The chemical conversion coating film included in the rust prevention member according to one embodiment of the present invention contains Si. A form of the contained Si is arbitrary. It is preferable that a component contained as a substance having a Si—O bond be contained in the chemical conversion coating film from a viewpoint of stability of the coating film, and specific examples thereof include silicon oxides such as colloidal silica and fumed silica. The silicon oxide may be subjected to a surface treatment.

The chemical conversion coating film included in the rust prevention member according to one embodiment of the present invention has a Si-rich region in which a ratio (atomic ratio, also referred to as a "Si/Zn ratio" in this specification) of a Si content (unit: atomic %) to a Zn content (unit: atomic %) is 1 or more on a surface layer side with a thickness of 100 nm or more. That is, the Si-rich region is a region in which the following Expression (1) is satisfied in the chemical conversion coating film.

$$[Si] \geq [Zn] \quad (1)$$

In the present specification, [Si] is a Si content (unit: atomic %) in the chemical conversion coating film, and [Zn] is a Zn content (unit: atomic %) in the chemical conversion coating film.

In the present specification, compositions of the chemical conversion coating film and the zinc-based plating layer refers to those obtained from results of X-ray photoelectron spectroscopy (XPS) analysis, and a composition distribution (depth profile) in a depth direction of the rust prevention member refers to that obtained by performing an XPS analysis while removing a surface of the rust prevention member by sputtering.

For example, an upper layer containing $SiO_2$ included in a two-layer structure chemical conversion treatment coating film described in Patent Literature 1 has a relatively high Si content, but the Si content (unit: atomic %) in the upper layer is less than a Zn content (unit: atomic %) therein as will be shown in examples to be described below. Therefore, the two-layer structure chemical conversion treatment coating film described in Patent Literature 1 does not have the Si-rich region defined in the present specification. In contrast, the chemical conversion coating film according to one embodiment of the present embodiment has a Si-rich region in which the Si content is equal to or higher than the Zn content with a thickness of 100 nm or more. Since such a Si-rich region is provided, the zinc-based plating layer positioned on an inward side of the chemical conversion coating film is appropriately protected, and a rust prevention member having excellent corrosion resistance, particularly white rust resistance, can be obtained. From a viewpoint of more stably improving corrosion resistance of the rust prevention member, there are cases in which a thickness of the Si-rich region is preferably 150 nm or more.

In a case in which Si positioned in the Si-rich region is derived from silicon oxide, the silicon oxide is thought to be held by oxides or hydroxides of elements other than Si contained in the chemical conversion coating film such as Zn derived from the zinc-based plating layer and chemical conversion elements.

The chemical conversion coating film included in the rust prevention member according to one embodiment of the present invention has a gradient region in which the Zn content increases toward the zinc-based plating layer between the Si-rich region and the zinc-based plating layer. In the present specification, the gradient region refers to a region positioned on the zinc-based plating layer side in contact with the Si-rich region and having a Zn content of 0.8 or less as a ratio to the Zn content in the zinc-based plating layer. Accordingly, the following Expression (2-1) and the following Expression (2-2) are satisfied in the gradient region.

$$[Si]/[Zn] \leq 1 \quad (2\text{-}1)$$

$$[Zn] \leq 0.8 \times [Zn]_0 \quad (2\text{-}2)$$

Here, $[Zn]_0$ is the Zn content (unit: atomic %) in the zinc-based plating layer. Therefore, for example, when the zinc-based plating layer is formed of Zn—Ni alloy plating and a Ni eutectoid rate of this plating is 18 atomic %, $[Zn]_0$ is 82 atomic %, and the above Expression (2-2) is $[Zn] \leq 65.6$ atomic %. Compositions of the zinc-based plating layer may be measured using a fluorescent X-ray film thickness meter or the like that is generally used when measuring a thickness of a plating layer.

In the gradient region, the Si content decreases toward the zinc-based plating layer, while the Zn content increases toward the zinc-based plating layer as described above. When such a gradient region is provided, components containing Si such as silicon oxide contained in the Si-rich region positioned on a surface of the zinc-based plating layer do not become detached from the rust prevention member. From a viewpoint of more stably reducing a likelihood of the components included in the Si-rich region becoming detached, a thickness of the gradient region may be preferably 50 nm or more, more preferably 100 nm or more, and particularly preferably 150 nm or more.

In the chemical conversion coating film, the Si-rich region and the gradient region are preferably continuous in a thickness direction. When these regions are continuous, peeling off at an interface between these regions does not easily occur. As shown in examples to be described below, in the chemical conversion coating film of the rust prevention member according to one embodiment of the present invention, it can be clearly ascertained that change in Si/Zn ratio is continuous, and the Si-rich region and the gradient region are continuous in the thickness direction in a boundary region between the Si-rich region and the gradient region, that is, a region in which the Si/Zn ratio is close to 1.

From a viewpoint of enhancing adhesion between the zinc-based plating layer and the chemical conversion coating film, there are cases in which the chemical conversion coating film is preferably a chemical conversion coating film of a reactive type. Also, the chemical conversion coating film may contain substantially no organic binder components. From a viewpoint of improving dimensional accuracy and from a viewpoint of stability in corrosion resistance with aging, it is preferable that a component containing Zn or a chemical conversion element, rather than an organic binder component, mainly function as a binder for components containing Si such as silicon oxide in some cases.

The chemical conversion coating film may contain elements other than Si and Zn derived from the zinc-based plating layer. As such elements, Cr, P, B, C, S, O, Li, Ca, Mg, Mo, V, Nb, Ta, W, Zr, Fe, Ni, Co, Cu, Si, Ti, Zn, Al, Sn, Bi, and lanthanoids may be exemplified. One or more elements selected from the group consisting of these elements can be contained as the above-described chemical conversion elements or for other purposes. Contents of the elements stated above are appropriately set in a range with which the purpose of being contained is fulfilled. Further, when a component containing Si contained in the chemical conversion coating film includes silicon oxide, the chemical conversion coating film contains O (oxygen) as a constituent element of the silicon oxide.

A method for producing a rust prevention member according to one embodiment of the present invention is not limited. The base material can be formed by machining such as rolling, cutting, and pressing, or molding. After the base material is prepared, the rust prevention member can be produced by implementing a plating step and a chemical conversion treatment step to be described below.

In the plating step, a zinc-based plating layer is formed on the base material to obtain a member to be treated having the base material and the zinc-based plating layer. As described above, the zinc-based plating layer may be formed by electroplating or may be formed by other methods.

In the chemical conversion treatment step, first, the member to be treated is brought into contact with a chemical conversion treatment liquid by a method such as immersion. The chemical conversion treatment liquid in this case contains a chemical conversion element-containing substance in which a chemical conversion element is contained, and silicon oxide. Treatment conditions such as a temperature of the chemical conversion treatment liquid and an immersion time are appropriately set in consideration of a composition of the chemical conversion treatment liquid and a composition of the chemical conversion coating film to be formed. When the chemical conversion treatment liquid is a reactive type, after the member to be treated is brought into contact with the chemical conversion treatment liquid for a predetermined time, the member to be treated is washed with water or the like to stop the chemical conversion reaction, and thereby the chemical conversion coating film is obtained. In this way, the chemical conversion coating film can be formed on the member to be treated.

The embodiment described above is a description for facilitating understanding of the present invention and is not intended to limit the present invention. Therefore, each component disclosed in the above-described embodiment is intended to include all design changes and equivalents belonging to the technical scope of the present invention. For example, the chemical conversion coating film may contain an organic binder component. In this case, a component that imparts an organic binder component may be contained in the chemical conversion treatment liquid, and a region that can be positioned also as an organic overcoat for the inorganic chemical conversion coating film described above may be formed on the Si-rich region.

EXAMPLES

Hereinafter, effects of the present invention will be described on the basis of examples, but the present invention is not limited thereto.

Example 1

A rust prevention member was made under the following conditions.

Base material: steel plate

Zinc-based plating layer: electrogalvanizing

Figure 2:
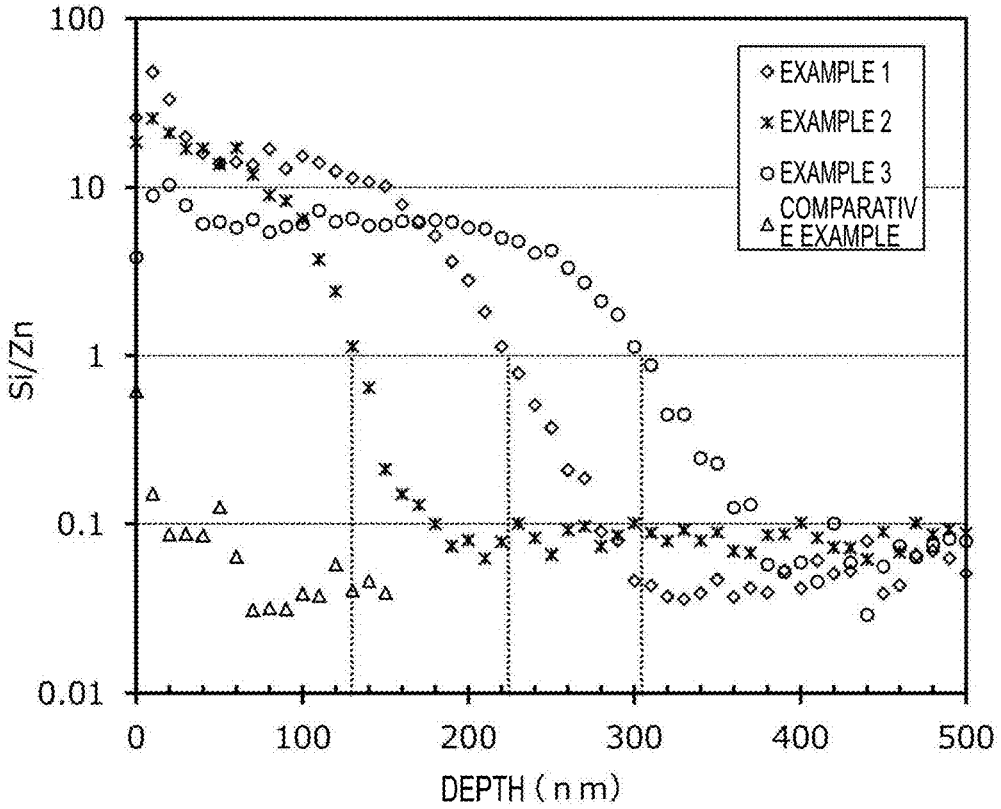
FIG. 2 is a graph showing change in a Si/Zn ratio in a depth direction calculated on the basis of the depth profile of FIG. 1 etc.

Chemical conversion treatment liquid: Cr (trivalent chromium) was used as a chemical conversion element, and colloidal silica was contained Chemical conversion treatment: immersion in the chemical conversion treatment liquid for 40 seconds, water washing, and drying A composition distribution (depth profile) in a thickness direction was measured for the obtained rust prevention member using an XPS analyzer. A graph showing measurement results and a graph showing change in a Si/Zn ratio in a depth direction calculated from the results are shown in FIGS. 1 and 2, respectively. As shown in FIGS. 1 and 2, a thickness of the Si-rich region was about 220 nm, and a thickness of the chemical conversion coating film was about 300 nm. Therefore, in Example 1, a thickness of the gradient region positioned to be continuous with the Si-rich region was about 80 nm. As the reason why the chemical conversion coating film is formed thick in this way, a chemical conversion reaction thereof having been slowly proceeded by adjusting conditions of the chemical conversion treatment can be stated.

Also, the rust prevention member was provided for the neutral salt water spray test described in JIS Z2371:2015, the test was visually observed at predetermined time intervals to determine whether or not white rust was generated, and measurement for a white rust generation area ratio was performed when the white rust was generated. The measurement results are shown in Table 1.

TABLE 1

| Testing time (hr) | Example 1 | Comparative example |
|---|---|---|
| 216 | 2% | 15% |
| 312 | 3% | 80% |

Example 2

Figure 3:
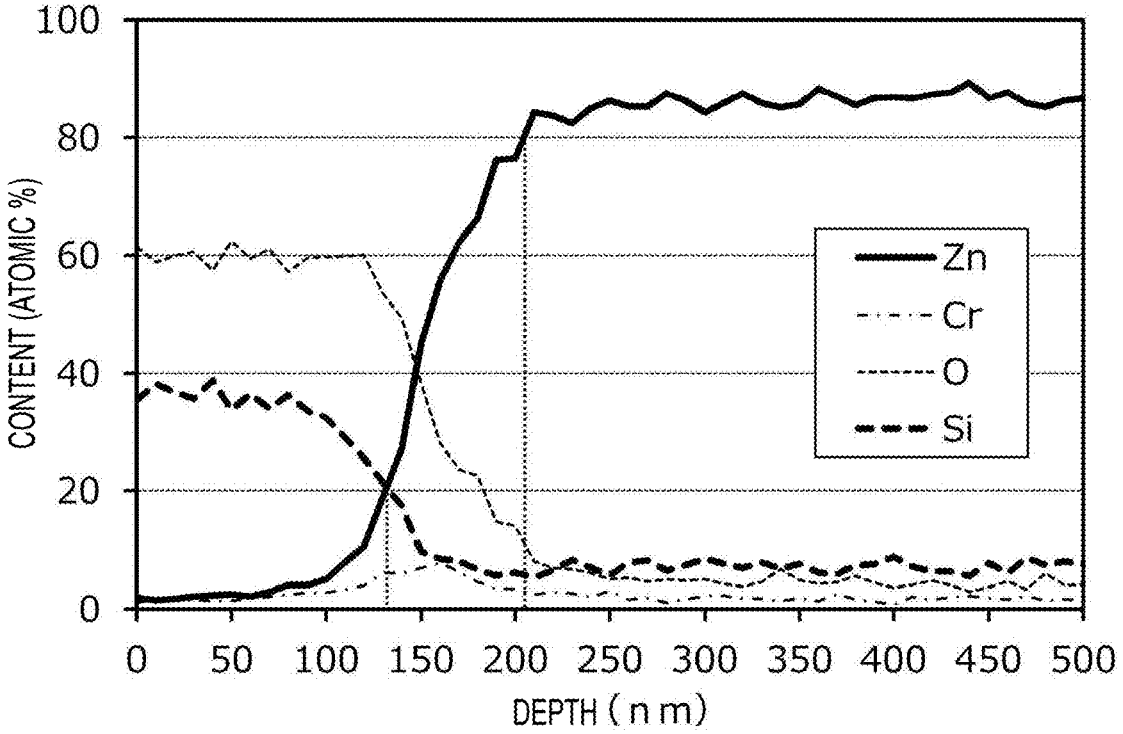
FIG. 3 is a depth profile of a rust prevention member according to Example 2.

Although conditions were the same as those in Example 1, a rust prevention member was obtained by changing the immersion time in the chemical conversion treatment liquid from 40 seconds to 20 seconds. A depth profile was measured also for this rust prevention member, and a Si/Zn ratio was calculated. These results are shown in FIGS. 3 and 2. As shown in FIGS. 3 and 2, a thickness of the Si-rich region was about 130 nm, and a thickness of the chemical conversion coating film was about 200 nm. Therefore, in Example 2, a thickness of the gradient region positioned to be continuous with the Si-rich region was about 70 nm.

Example 3

Figure 4:
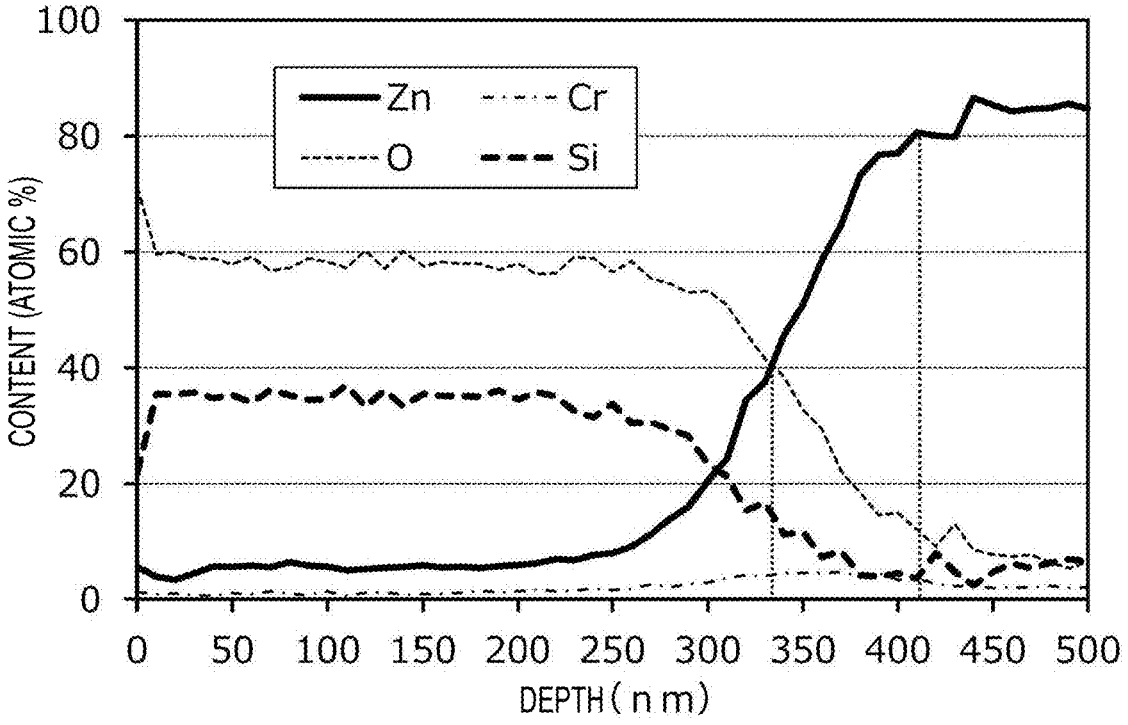
FIG. 4 is a depth profile of a rust prevention member according to Example 3.

Although conditions were the same as those in Example 1, a rust prevention member was obtained by changing the immersion time in the chemical conversion treatment liquid from 40 seconds to 60 seconds. A depth profile was measured also for this rust prevention member, and a Si/Zn ratio was calculated. These results are shown in FIGS. 4 and 2. As shown in FIGS. 4 and 2, a thickness of the Si-rich region was about 300 nm, and a thickness of the chemical conversion coating film was about 400 nm. Therefore, a thickness of the gradient region positioned to be continuous with the Si-rich region was about 100 nm.

Comparative Example

Figure 5:
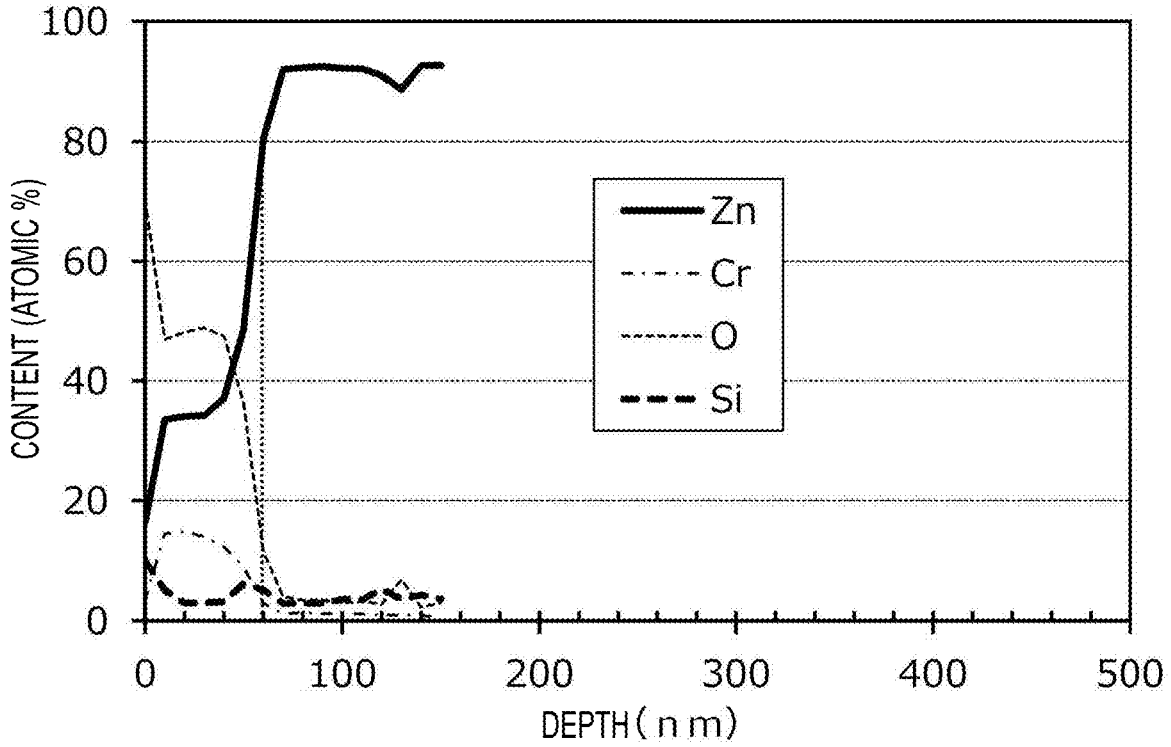
FIG. 5 is a depth profile of a rust prevention member according to Comparative example.
Figure 6:
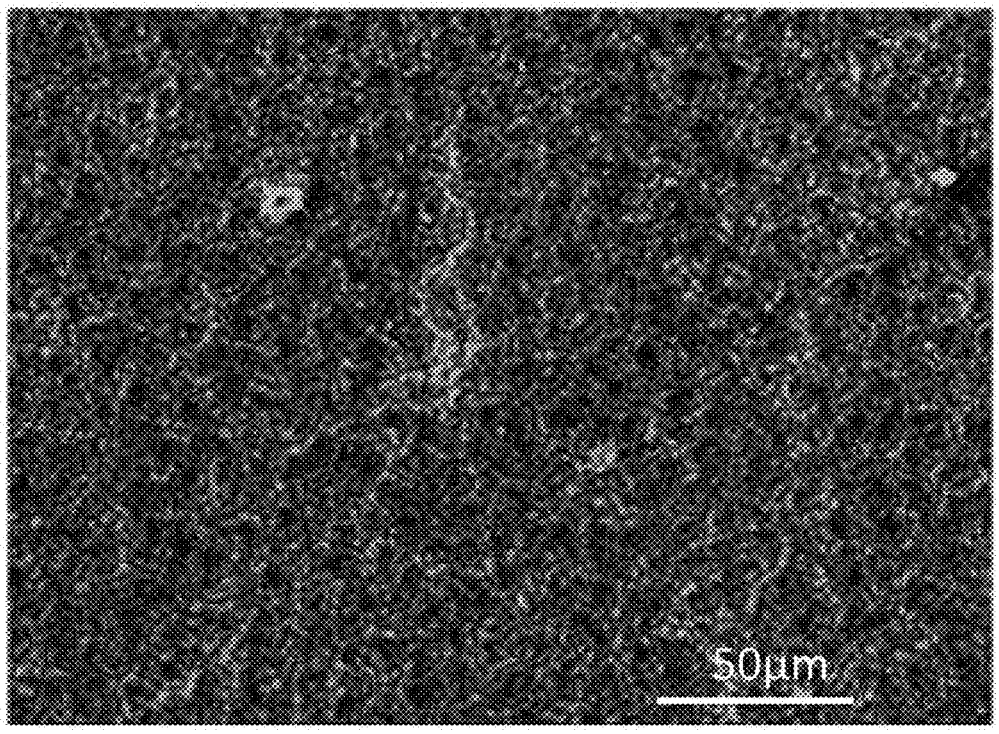
FIG. 6 is a view showing a surface observation result of the rust prevention member according to Example 1.
Figure 7:
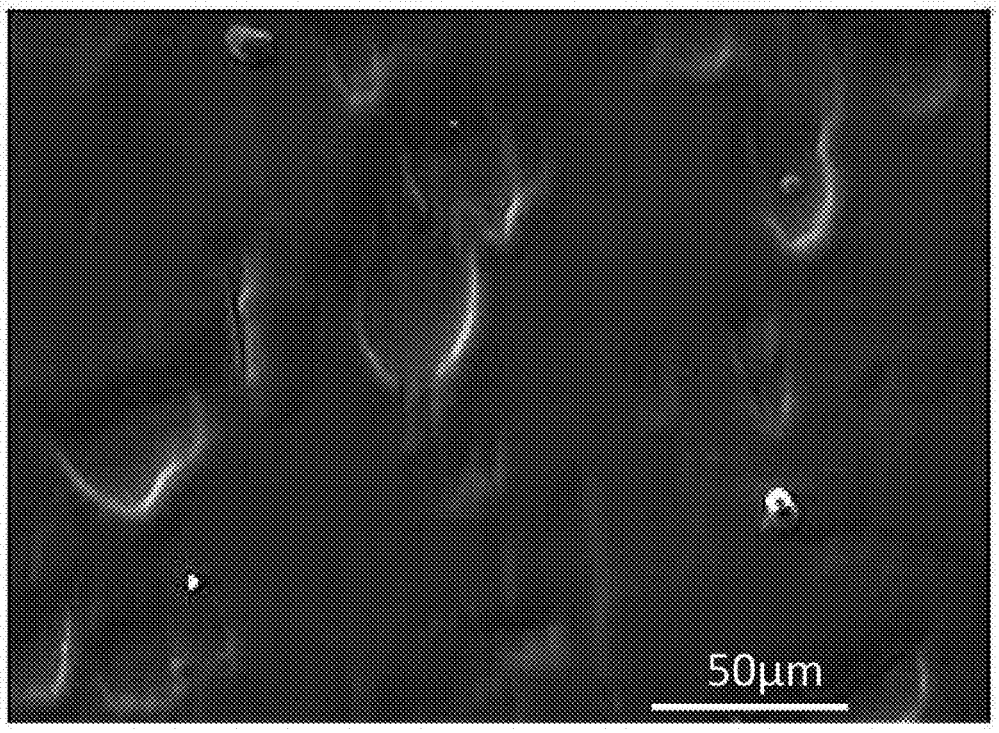
FIG. 7 is a view showing a surface observation result of the rust prevention member according to Comparative example.

Although conditions were the same as those in Example 1, a rust prevention member was obtained by performing the chemical conversion treatment shown in Example 1 of Patent Literature 1. A depth profile was measured also for this rust prevention member, and a Si/Zn ratio was calculated. These results are shown in FIGS. 5 and 2. In the chemical conversion coating film of the rust prevention member according to Comparative example, there was no Si-rich region having the Si/Zn ratio of 1 or more, and a thickness of the chemical conversion coating film was about 60 nm. When a surface of the chemical conversion coating film according to Comparative example was observed, as shown in FIG. 7, a surface form thereof was significantly different from a surface (FIG. 6) of the chemical conversion coating film according to Example 1. Also, the neutral salt water spray test was performed in the same manner as in Example 1. The results are shown in Table 1.

Example 4

Although conditions were the same as those in Example 1, a rust prevention member was obtained by forming the zinc-based plating layer using a Zn—Ni alloy electroplating instead of the electrogalvanizing. When a composition of the formed zinc-based plating layer was checked using a fluorescent X-ray film thickness meter, Zn was 82 atomic % and Ni was 18 atomic %. Therefore, from the above Expression (2-2), the zinc content is 65.6 atomic % or less in the gradient region of the chemical conversion coating film provided in the rust prevention member according to Example 4.

Figure 8:
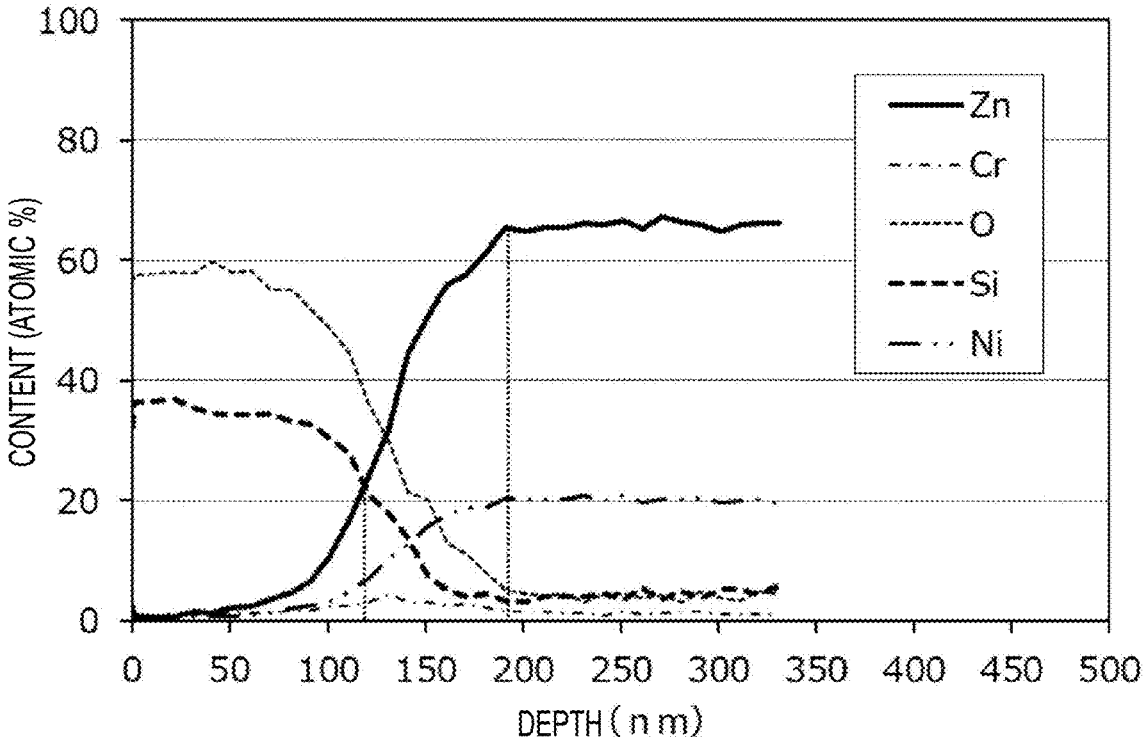
FIG. 8 is a depth profile of a rust prevention member according to Example 4.
Figure 9:
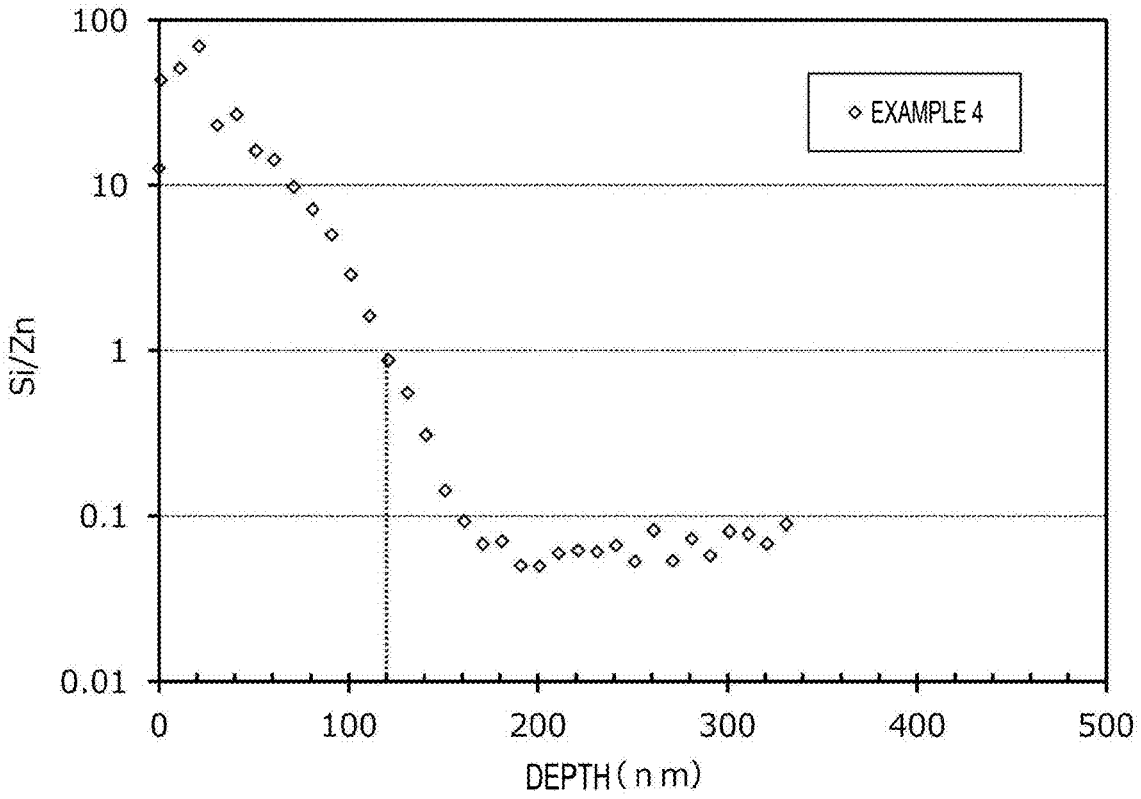
FIG. 9 is a graph showing change in a Si/Zn ratio in a depth direction calculated on the basis of the depth profile of FIG. 8.

For the rust prevention member obtained in this way, a depth profile was measured and a Si/Zn ratio was calculated. These results are shown in FIGS. 8 and 9. As shown in FIGS. 8 and 9, similar to the case in which the zinc-based plating layer was formed by the electrogalvanizing, also in the case in which the zinc-based plating layer was formed by the Zn—Ni alloy electroplating, the Si-rich region having a Si/Zn ratio of 1 or more was present in the chemical conversion coating film of the rust prevention member, and a thickness thereof was about 120 nm, and a thickness of the chemical conversion coating film was about 190 nm. Therefore, in Example 4, a thickness of the gradient region positioned to be continuous with the Si-rich region was about 70 nm. These results were close to those in Example 2 shown in FIG. 3 or the like.

Example 5 to Example 17

A rust prevention member having a chemical conversion coating film of a reactive type was made under the following conditions.

Base material: steel plate

Zinc-based plating layer: as shown in Table 2

Zn: the same electrogalvanizing as in Example 1

Zn—Ni: the same Zn—Ni alloy electroplating as in Example 4

Chemical conversion treatment liquid: the elements shown in Table 2 were used as chemical conversion elements, and colloidal silica was contained.

Chemical conversion treatment: immersion in the chemical conversion treatment liquid for 40 seconds, water washing, and drying

TABLE 2

| | | Example | | | | | | | | | | | | | | | | |
|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 |
| Types of plating | | Zn | Zn | Zn | Zn—Ni | Zn | Zn | Zn | Zn | Zn | Zn | Zn | Zn | Zn | Zn | Zn | Zn—Ni | Zn—Ni |
| Chemical conversion element | Cr | ○ | ○ | ○ | ○ | | | | | | | ○ | ○ | ○ | ○ | ○ | ○ | |
| | F | | | | | | | | | | ○ | | | | | | | |
| | Mg | | | | | | | | | | | | ○ | | | | | |
| | Mo | | | | | ○ | | | | | | | | | | | ○ | |
| | V | | | | | | ○ | | | | | | | | | | | ○ |
| | W | | | | | | | ○ | | | | | | | | | | |
| | Zr | | | | | | | | ○ | | | | | | | | | |
| | Ni | | | | | | | | | | | | | ○ | | | | |
| | Co | | | | | | | | | | | | | | ○ | | | |
| | Ti | | | | | | | | | | | ○ | | | | | | |

TABLE 2-continued

| | Example | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Zn | | | | | | | | | | | | | | | ○ | | |
| Al | | | | | | | | | ○ | | | | | | | | |
| Thickness of Si-rich region (nm) | 220 | 130 | 300 | 120 | 300 | 250 | 300 | 150 | 150 | 200 | 400 | 200 | 220 | 250 | 200 | 150 | 150 |

For the rust prevention member obtained in this way, a depth profile was measured as in Example 1, and from the obtained depth profile, a thickness (unit: nm) of the Si-rich region having a Si/Zn ratio of 1 or more was obtained. The results were shown in Table 2. Further, the results of Examples 1 to 4 were also shown in Table 2 from a viewpoint of facilitating comparison. As shown in Table 2, it was ascertained that, even when elements of various types such as P, Mg, Ti, and Mo were used as the chemical conversion elements other than the Cr used in Examples 1 to 4, the chemical conversion coating film having the Si-rich region with a thickness of 100 nm or more was formed. Also, it was ascertained that the chemical conversion coating film having the Si-rich region with a thickness of 100 nm or more was formed even when a plurality of chemical conversion elements were used.

The invention claimed is:

1. A rust prevention member comprising:

a base material;

a zinc-based plating layer provided on the base material; and a chemical conversion coating film provided on the zinc-based plating layer and containing Si, wherein the chemical conversion coating film has a Si-rich region in which an atomic ratio of a Si content to a Zn content is 1 or more on a surface layer side with a thickness of 100 nm or more, and the chemical conversion coating film has a gradient region with a thickness of 50 nm or more in which the Zn content increases toward the zinc-based plating layer while the Si content decreases toward the zinc-based plating layer between the Si-rich region and the zinc-based plating layer, wherein the following Expression (2-1) and the following Expression (2-2) are satisfied in the gradient region, $$[Si]/[Zn]<1 \quad (2\text{-}1)$$

$$[Zn]\leq 0.8\times[Zn]_0 \quad (2\text{-}2)$$

wherein [Si] is a Si content in atomic % in the chemical conversion coating film, [Zn] is a Zn content in atomic % in the chemical conversion coating film, and $[Zn]_0$ is a Zn content in atomic % in the zinc-based plating layer, and wherein the Si-rich region and the gradient region are continuous in a thickness direction.

2. The rust prevention member according to claim 1, wherein the chemical conversion coating film further contains one or more elements selected from the group consisting of Cr, P, B, C, S, O, Li, Ca, Mg, Mo, V, Nb, Ta, W, Zr, Fe, Ni, Co, Cu, Si, Ti, Zn, Al, Sn, Bi, and lanthanoids.

3. The rust prevention member according to claim 1, wherein the chemical conversion coating film is a chemical conversion coating film of a reactive type.

4. The rust prevention member according to claim 1, wherein the chemical conversion coating film contains silicon oxide.

5. The rust prevention member according to claim 1, wherein the chemical conversion coating film contains substantially no organic binder component.

6. A method for producing the rust prevention member according to claim 4 comprising:

a plating step of forming the zinc-based plating layer on the base material to obtain a member to be treated having the base material and the zinc-based plating layer; and a chemical conversion treatment step of forming the chemical conversion coating film on the member to be treated by bringing the member to be treated into contact with a chemical conversion treatment liquid and then washing the member to be treated, wherein the chemical conversion treatment liquid contains a chemical conversion element-containing substance containing an element that performs a chemical conversion reaction, and silicon oxide.

* * * * *